US011686505B2

(12) United States Patent
Seo et al.

(10) Patent No.: US 11,686,505 B2
(45) Date of Patent: Jun. 27, 2023

(54) REFRIGERATOR

(71) Applicant: Samsung Electronics Co., Ltd., Suwon-si (KR)

(72) Inventors: Tatsuya Seo, Yokohama (JP); Hiroshi Nakamura, Yokohama (JP); Ryota Aoki, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 87 days.

(21) Appl. No.: 17/410,431

(22) Filed: Aug. 24, 2021

(65) Prior Publication Data

US 2022/0163238 A1 May 26, 2022

(51) Int. Cl.

| | |
|---|---|
| ***F25B 5/02*** | (2006.01) |
| ***F25D 11/02*** | (2006.01) |
| ***F25D 29/00*** | (2006.01) |

(52) U.S. Cl.

CPC ..... *F25B 5/02* (2013.01); *F25D 11/022* (2013.01); *F25D 29/00* (2013.01); *F25B 2600/2511* (2013.01); *F25D 2400/04* (2013.01); *F25D 2700/10* (2013.01)

(58) Field of Classification Search

CPC .... F25B 5/02; F25B 2600/2511; F25B 41/20; F25B 2700/21174; F25B 41/37; F25B 41/385; F25B 49/02; F25D 2700/10; F25D 29/00

See application file for complete search history.

(56) References Cited

U.S. PATENT DOCUMENTS 3,977,205 A * 8/1976 Dreisziger ..... F25B 39/02 62/504
2013/0186129 A1* 7/2013 Bae ..... F25B 5/02 62/498

(Continued)

FOREIGN PATENT DOCUMENTS

CN 1673654 A * 9/2005
CN 112303993 A * 2/2021 ..... F25B 1/00

(Continued)

OTHER PUBLICATIONS

International Search Report dated Dec. 15, 2021, issued in International Application No. PCT/KR2021/011215.

*Primary Examiner* — Kun Kai Ma
(74) *Attorney, Agent, or Firm* — Jefferson IP Law, LLP

(57) ABSTRACT

A refrigerator is provided. The refrigerator includes a plurality of refrigerant flow paths, configured to reduce the drift of the refrigerant. The refrigerator includes a refrigeration cycle including a compressor, a condenser, a plurality of refrigerant flow paths branched at a downstream of the condenser, the plurality of refrigerant flow paths each including a pressure reducing device, and an evaporator connected to the plurality of refrigerant flow paths, and a processor including a switching valve configured to individually switch an open or closed state of each of the plurality of refrigerant flow paths, the processor being configured to adjust a flow rate of refrigerant flowing in each of the plurality of refrigerant flow paths by individually duty-controlling an opening and closing time of each of the plurality of refrigerant flow paths by controlling the switching valve.

18 Claims, 5 Drawing Sheets

(56) References Cited

U.S. PATENT DOCUMENTS

| | | | | |
|---|---|---|---|---|
| 2013/0213065 | A1* | 8/2013 | Gomes | F25B 49/022 62/216 |
| 2015/0168040 | A1* | 6/2015 | Kang | F25B 5/04 62/186 |
| 2021/0102745 | A1* | 4/2021 | Vijayan | F25D 23/04 |

FOREIGN PATENT DOCUMENTS

| | | | | | |
|---|---|---|---|---|---|
| CN | 114719471 | A | * | 7/2022 | |
| JP | 2002062020 | A | * | 2/2002 | |
| JP | 2004-293820 | A | | 1/2009 | |
| JP | 5973852 | B2 | | 8/2016 | |
| KR | 10-2013-0096963 | A | | 9/2013 | |
| KR | 10-2015-0063930 | A | | 6/2015 | |
| KR | 10-2020-0099507 | A | | 8/2020 | |
| WO | WO-2005124250 | A1 | * | 12/2005 | F25B 39/022 |
| WO | WO-2021009102 | A1 | * | 1/2021 | F25B 40/00 |

* cited by examiner

REFRIGERATOR

CROSS-REFERENCE TO RELATED APPLICATION(S)

This application is based on and claims priority under 35 U.S.C. § 119 (a) of a Japanese patent application number 2020-193074, filed on Nov. 20, 2020, in the Japan Patent Office, and of a Korean patent application number 10-2021-0053002, filed on Apr. 23, 2021, in the Korean Intellectual Property Office, the disclosures of each of which is incorporated by reference herein in its entirety.

BACKGROUND

1. Field

The disclosure relates to a refrigerator.

2. Description of Related Art

Conventionally, a refrigerator, in which two refrigerant flow paths in parallel are connected to an evaporator and the two refrigerant flow paths are opened and closed according to an operation method of the refrigerator in order to reduce unnecessary cooling of the evaporator, has been disclosed. As for the refrigerator, a refrigerant is suppled to only one refrigerant flow path in good contact with cold air, which returns from a refrigerating compartment, during a cooling operation of the refrigerating compartment, and a refrigerant is suppled to only one refrigerant flow path in good contact with cold air, which returns from a freezing compartment, during a cooling operation of the freezing compartment.

However, in the above-mentioned refrigerator, because the refrigerant flows on one of the two refrigerant flow paths passing through the evaporator, the other refrigerant flow path, to which the refrigerant is not supplied, may be covered with frost and thus a flow of cold air may be changed, thereby significantly reducing heat exchange efficiency. It can also be considered to supply the refrigerant to both of the plurality of refrigerant flow paths to respond to the change in the cold air flow caused by the frost, but in this case, it may cause the drift that is the refrigerant flows only on the refrigerant flow path with a low fluid resistance among the plurality of refrigerant flow paths.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a refrigerator, in which heat exchange is performed by a plurality of refrigerant flow paths, capable of reducing drift of refrigerant.

Additional aspects will be set forth in part in the description which follows and, in part, will be apparent from the description, or may be learned by practice of the presented embodiments.

In accordance with an aspect of the disclosure, a refrigerator is provided. The refrigerator includes a refrigeration cycle including a compressor, a condenser, a plurality of refrigerant flow paths branched at a downstream of the condenser and including a pressure reducing device, respectively, and an evaporator connected to the plurality of refrigerant flow paths, respectively, and a processor including a switching valve configured to individually switch an open and closed state of each of the plurality of refrigerant flow paths, the processor configured to adjust a flow rate of refrigerant flowing in the each of the plurality of refrigerant flow paths by individually duty-controlling an opening and closing time of the each of the plurality of refrigerant flow paths by controlling the switching valve.

The processor may be configured to set a duty ratio of the duty control, which is for a refrigerant flow path, among the plurality of refrigerant flow paths, having a relatively large amount of cold air performing heat exchange, to be greater than a duty ratio of the duty control, which is for a refrigerant flow path, among the plurality of refrigerant flow paths, having a relatively less amount of cold air performing the heat exchange.

The plurality of refrigerant flow paths may include a first refrigerant flow path and a second refrigerant flow path.

The processor may be configured to control the switching valve to close the second refrigerant flow path in response to opening the first refrigerant flow path, and the processor may be configured to control the switching valve to open the second refrigerant flow path in response to closing the first refrigerant flow path.

An all-closed state, in which all of the plurality of refrigerant flow paths are maintained in the closed state during a cooling operation, may be provided.

The refrigerator may further include a plurality of return flow paths provided to return cold air supplied into a main body back to the evaporator.

The processor may be configured to set a duty ratio of the duty control for the each of the plurality of refrigerant flow paths according to an amount of cold air flowing through each of the plurality of return flow paths.

The plurality of return flow paths may be arranged at the front and rear of the evaporator so as to supply the cold air inside the main body again to the evaporator.

The plurality of flow paths may be arranged side by side in a front and rear direction in the evaporator.

The plurality of return flow paths may be arranged on left and right sides of the evaporator so as to supply the cold air inside the main body again to the evaporator.

The plurality of refrigerant flow paths may be arranged side by side in a left and right direction in the evaporator.

The refrigerator may further include an inlet side temperature sensor configured to measure a refrigerant temperature of the each of the plurality of refrigerant flow paths at an inlet side of the evaporator, and an outlet side temperature sensor configured to measure a refrigerant temperature of the each of the plurality of refrigerant flow paths at an outlet side of the evaporator.

The processor may be configured to set a duty ratio of the duty control for the each of the plurality of refrigerant flow paths based on a refrigerant temperature measured by the inlet side temperature sensor and a refrigerant temperature measured by the outlet side temperature sensor.

The refrigerator may further include a fan configured to circulate the cold air in the main body.

The processor may be configured to set a duty ratio of duty control for the each of the plurality of refrigerant flow paths based on a rotation speed of the fan.

The processor may be configured to set a duty ratio of duty control for the each of the plurality of refrigerant flow paths based on a rotation speed of the compressor.

The processor may be configured to set a duty ratio of duty control for the each of the plurality of refrigerant flow paths based on an internal temperature of the main body.

The processor may be configured to set a duty ratio of duty control for the each of the plurality of refrigerant flow paths based on a period of time elapsed after the start of the cooling operation.

The plurality of refrigerant flow paths may be provided to merge at one point at the downstream of the evaporator.

A period of the duty control for the each of the plurality of refrigerant flow paths may be set to be less than and equal to 200 seconds.

In accordance with another aspect of the disclosure, a refrigerator is provided. The refrigerator includes a refrigeration cycle including a compressor, a condenser, a plurality of pressure reducing devices, and an evaporator, a first refrigerant flow path branched at a point downstream of the condenser, including one of the plurality of pressure reducing devices, and connected to the evaporator, a second refrigerant flow path branched at a point downstream of the condenser, including another of the plurality of pressure reducing devices, and connected to the evaporator, a switching valve configured to individually switch an open and closed state of the first refrigerant flow path and the second refrigerant flow path, and a processor configured to adjust a flow rate of refrigerant flowing in the first refrigerant flow path and the second refrigerant flow path by individually duty-controlling an opening and closing time of the first refrigerant flow path and the second refrigerant flow path by controlling the switching valve.

The processor may be configured to set a duty ratio of the duty control for the first refrigerant flow path to be greater than a duty ratio of the duty control for the second refrigerant flow path in response to an amount of cold air exchanging heat with the first refrigerant flow path being greater than an amount of cold air exchanging heat with the second refrigerant flow path, and the processor may be configured to set a duty ratio of the duty control for the first refrigerant flow path to be less than a duty ratio of the duty control for the second refrigerant flow path in response to an amount of cold air exchanging heat with the first refrigerant flow path being less than an amount of cold air exchanging heat with the second refrigerant flow path.

An all-closed state, in which the first refrigerant flow path and the second refrigerant flow path are maintained in the closed state during a cooling operation in which the compressor is operated, may be provided.

The refrigerator may further include a plurality of return flow paths provided to return cold air supplied into a main body back to the evaporator.

The processor may be configured to set a duty ratio of the duty control for the first refrigerant flow path and the second refrigerant flow path according to an amount of cold air flowing through each of the plurality of return flow paths.

The plurality of return flow paths may be arranged at the front and rear of the evaporator so as to supply the cold air inside the main body again to the evaporator.

The first refrigerant flow path and the second refrigerant flow path may be arranged side by side in a front and rear direction in the evaporator.

The plurality of return flow paths may be arranged on left and right sides of the evaporator so as to supply the cold air inside the main body again to the evaporator.

The first refrigerant flow path and the second refrigerant flow path may be arranged side by side in a left and right direction in the evaporator.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, of which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
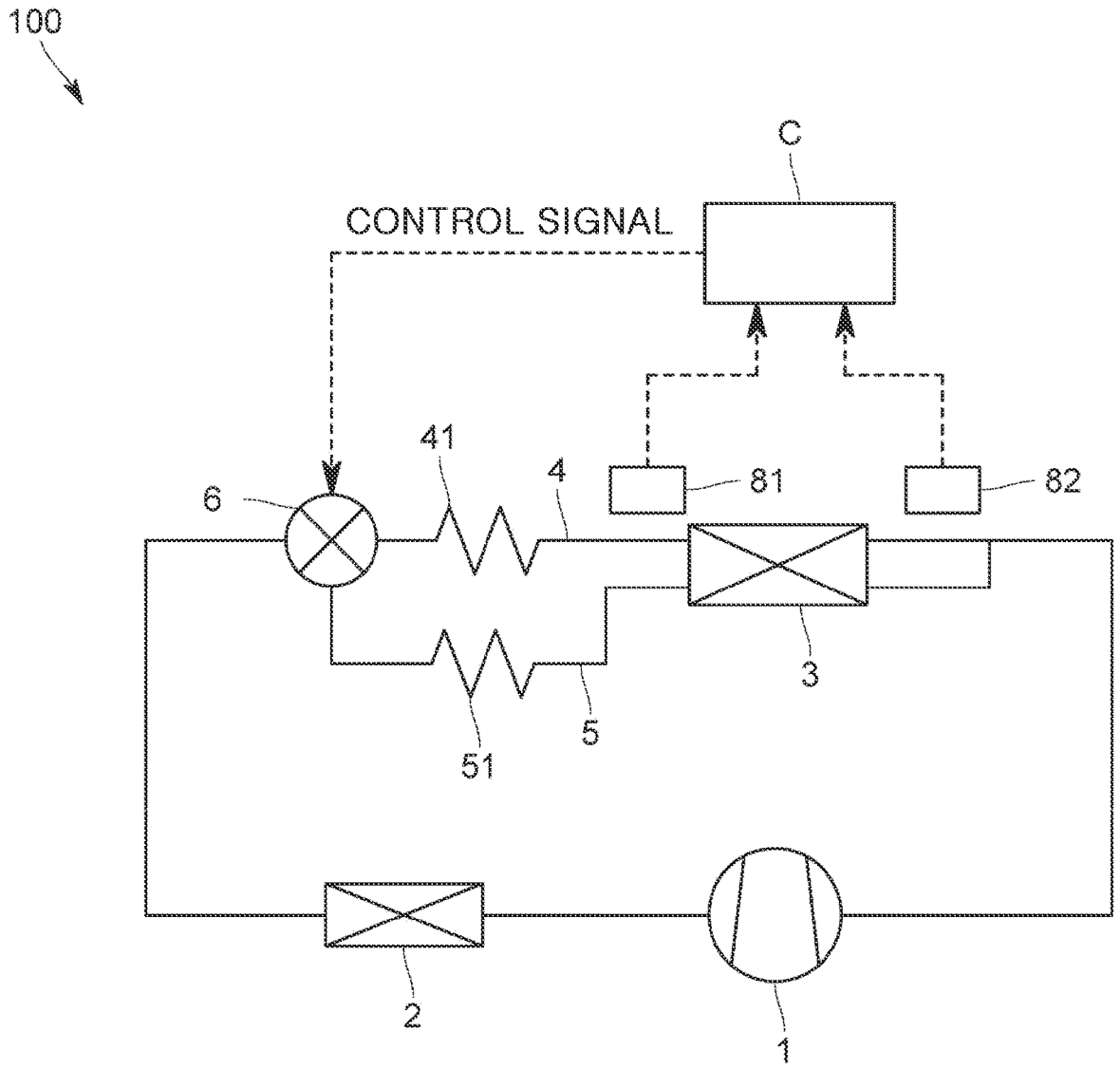
FIG. 1 is a diagram illustrating a refrigeration cycle of a refrigerator according to an embodiment of the disclosure.

FIG. 1 is a diagram illustrating a refrigeration cycle of a refrigerator according to an embodiment of the disclosure.

Referring to FIG. 1, according to an embodiment of the disclosure, the refrigerator 100 includes a refrigerating compartment and a freezing compartment, and the refrigerator 100 includes a refrigeration cycle including a compressor 1, a condenser 2 provided at an outlet side of the compressor 1, and an evaporator 3 provided between an outlet side of the condenser 2 and an inlet side of the compressor 1. The refrigeration cycle includes a plurality of refrigerant flow paths 4 and 5 connected in parallel to each other in order to perform heat exchange with the refrigerant, which is condensed in the condenser 2, in the evaporator 3. The plurality of refrigerant flow paths 4 and 5 are branched at a downstream of the condenser 2, and the evaporator 3 is provided by passing through the plurality of refrigerant flow paths 4 and 5. That is, each of the refrigerant flow paths 4 and 5 may be provided to pass through an inside of one evaporator 3. The refrigeration cycle according to an embodiment of the disclosure includes two refrigerant flow paths, such as a first refrigerant flow path 4 and a second refrigerant flow path 5.

The first refrigerant flow path 4 and the second refrigerant flow path 5 may be provided to be divided into each other at a branch point provided between the evaporator 3 and the condenser 2, and the first refrigerant flow path 4 and the second refrigerant flow path 5 may merge again on the downstream of the evaporator 3. The first refrigerant flow path 4 and the second refrigerant flow path 5 may include a first pressure reducing device 41 and a second pressure reducing device 51, respectively that are provided to depressurize the refrigerant on an upstream of the evaporator 3. Particularly, the first pressure reducing device 41 and the second pressure reducing device 51 may include a capillary tube.

Hereinafter the evaporator 3 and a peripheral configuration of the evaporator 3 of the refrigerator 100 according to an embodiment of the disclosure will be described.

Figure 2:
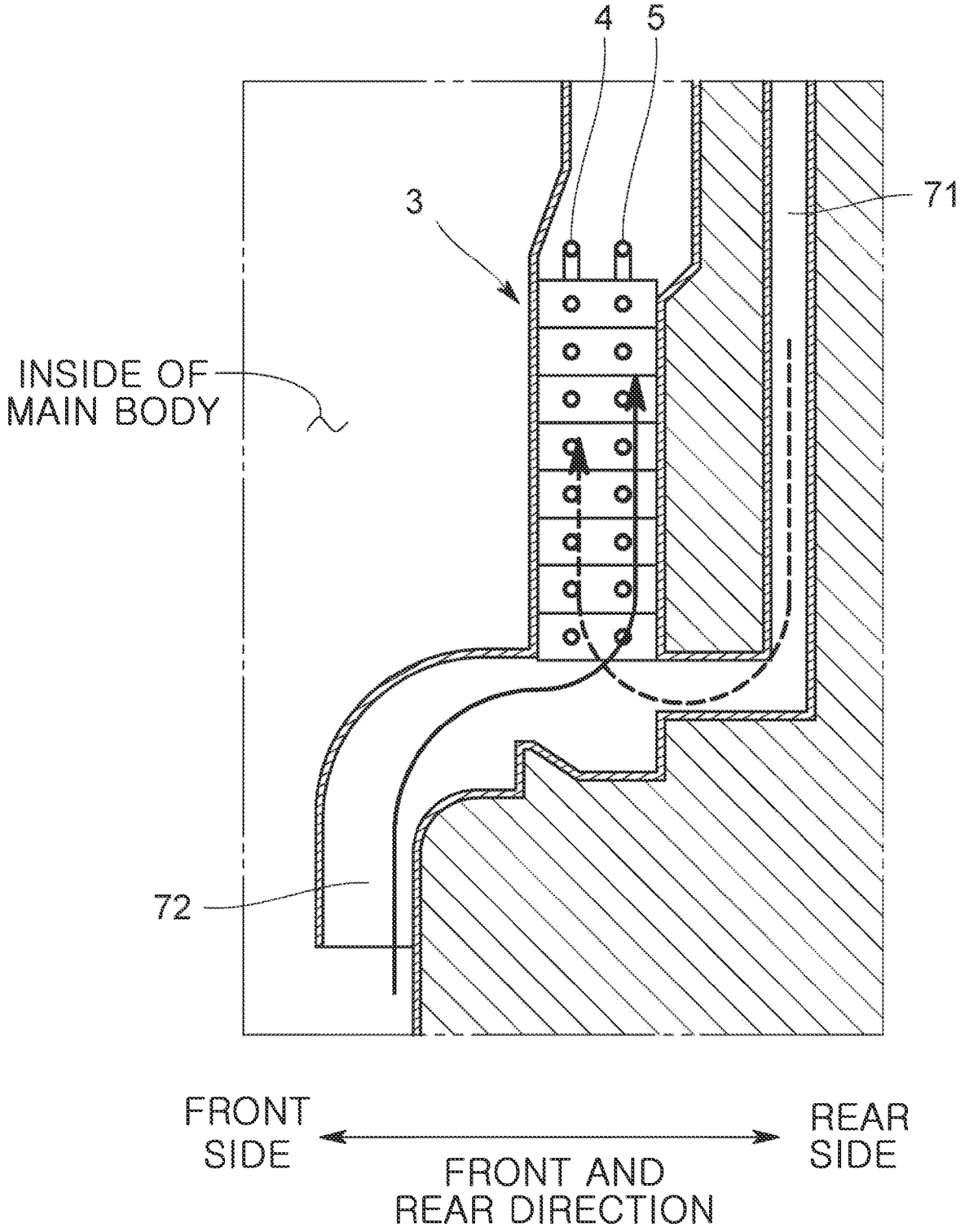
FIG. 2 is a schematic view illustrating a configuration of an evaporator of the refrigerator according to an embodiment of the disclosure.

FIG. 2 is a schematic view illustrating a configuration of an evaporator of the refrigerator according to an embodiment of the disclosure.

Referring to FIG. 2, the refrigerator 100 may include a plurality of return flow paths provided to return cold air, which is supplied to an inside of a main body, to the evaporator 3. Particularly, the refrigerator 100 may include a first return flow path 71 provided to return cold air, which is supplied to the refrigerating compartment, to the evaporator 3, and a second return flow path 72 provided to return cold air, which is supplied to the freezing compartment, to the evaporator 3. In the evaporator 3, each of the refrigerant flow paths 4 and 5 may be configured to allow wind (cold air) that is introduced from the first return flow path 71 and wind (cold air) that is introduced from the second return flow path 72 to perform heat exchange.

According to an embodiment of the disclosure, the first refrigerant flow path 4 and the second refrigerant flow path 5 may be arranged in a front and rear direction. The first refrigerant flow path 4 may be arranged at the front, and the second refrigerant flow path 5 may be arranged at the rear. Each of the return flow paths 71 and 72 may be provided in the front and rear direction of the refrigerator 100 so as to return cold air to the evaporator 3, and the each of the refrigerant flow paths 4 and 5 may be installed side by side in the front and rear direction with respect to the evaporator 3.

In addition, the refrigerator 100 according to an embodiment of the disclosure may include a processor configured to adjust a flow rate of the refrigerant flowing in the refrigerant flow paths 4 and 5, as illustrated in FIG. 1.

The processor may include a switching valve 6 configured to switch an open and closed state of the first refrigerant flow path 4 and the second refrigerant flow path 5, and a controller C configured to control the switching valve 6. Hereinafter the controller C may include a processor.

The switching valve 6 may include a three-way valve provided at a branch point of the first refrigerant flow path 4 and the second refrigerant flow path 5. An input port of the three-way valve may be connected to a refrigerant pipe on the condenser 2 side. A first output port of the three-way valve may be connected to a branch pipe forming the first refrigerant flow path 4. A second output port of the three-way valve may be connected to a branch pipe forming the second refrigerant flow path 5. Accordingly, based on the control signal of the controller C, the switching valve 6 may individually control opening and closing of the first output port and the second output port.

Hereinafter an operation of the processor will be described with reference to FIG. 3.

Figure 3:
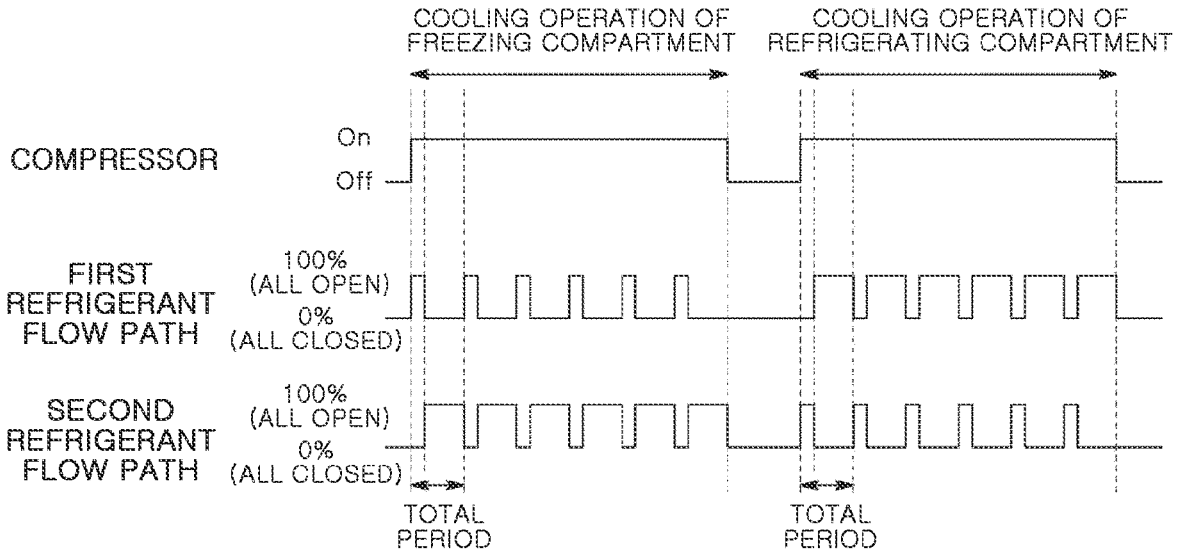
FIG. 3 is a view illustrating control of the refrigerator according to an embodiment of the disclosure.

FIG. 3 is a view illustrating control of the refrigerator according to an embodiment of the disclosure.

The processor is configured to individually perform duty control of an opening and closing time of each of the refrigerant flow paths 4 and 5 by switching the open and closed state of each port of the switching valve 6 during the compressor 1 is operated, that is, during a cooling operation. That is, the refrigerant may intermittently flow on each of the refrigerant flow paths 4 and 5 at a constant cycle. Accordingly, the processor may adjust the flow rate of the refrigerant flowing through each of the refrigerant flow paths 4 and 5 independently of each other, and accordingly, the processor may adjust a fraction ratio of the refrigerant flowing in the evaporator 3.

Particularly, the processor may allow a period (or a total period) and a start timing of the duty control of the first refrigerant flow path 4 to be the same as a period (or total period) and a start timing of the duty control of the second refrigerant flow path 5. The processor may allow a period of time, in which each of the refrigerant flow paths 4 and 5 is opened (on-time), to be alternately switched. That is, the processor may prevent each of the refrigerant flow paths 4 and 5 from being simultaneously opened. In response to the period of the duty control of the each of the refrigerant flow paths 4 and 5 being greater than 200 seconds, an amount of refrigerant supplied to the evaporator may be insufficient and thus the cooling efficiency may decrease. Therefore, it is appropriate that the period of the duty control of the each of the refrigerant flow paths 4 and 5 is set to be less than or equal to 200 seconds. According to an embodiment of the disclosure, the total period of the each of the refrigerant flow paths 4 and 5 may be set to be greater than or equal to 3 seconds, but less than or equal to 200 seconds.

In the duty control of the each of the refrigerant flow paths 4 and 5, the duty ratios may be greater than 0 (always off) but less than 1 (always on), and the sum thereof may be less than or equal to 1. The duty ratio of the each of the refrigerant flow paths 4 and 5 may be the same as or different from each other. In addition, the duty ratio within the total period may be constant or may change over time. The duty ratio is a ratio of an opening time to the total period.

Further, the processor may be configured to set a duty ratio of the duty control of each of the refrigerant flow paths 4 and 5 according to an operating state of the refrigerator 100.

For example, in the evaporator 3, the processor may control a duty ratio of a refrigerant flow path having a greater amount of cold air performing heat exchange to be greater than a duty ratio of another refrigerant flow path. It is possible to increase heat exchange efficiency by supplying a large amount of refrigerant to a refrigerant flow path, which is in contact with a relatively large amount of cold air, among the plurality of refrigerant flow paths.

According to an embodiment of the disclosure, the second refrigerant flow path 5 may perform heat exchange with a greater amount of cold air during the cooling operation of the freezing compartment, and the first refrigerant flow path 4 may perform heat exchange with a greater amount of cold air during the cooling operation of the refrigerating compartment. Accordingly, the processor may control the duty ratio of the second refrigerant flow path 5 to be greater than the duty ratio of the first refrigerant flow path 4 during the cooling operation of the freezing compartment, and the processor may control the duty ratio of the first refrigerant flow path 4 to be greater than the duty ratio of the second refrigerant flow path 5 during the cooling operation of the refrigerating compartment.

In addition, the processor may set the duty ratio of the each of the refrigerant flow paths 4 and 5 based on a temperature of the refrigerant at the inlet side of the evaporator 3 (an inlet-side refrigerant temperature) and a temperature of the refrigerant at the outlet side of the evaporator 3 (an outlet-side refrigerant temperature). The refrigerator 100 may include an inlet side temperature sensor 81 configured to detect a temperature of the refrigerant of the refrigerant flow paths 4 and 5 at the inlet side of the evaporator 3 and an outlet side temperature sensor 82 configured to detect a temperature of the refrigerant of the refrigerant flow paths 4 and 5 at the outlet side of the evaporator 3. The controller C may be configured to obtain an inlet-side refrigerant temperature and an outlet-side refrigerant temperature from each of the temperature sensors 81 and 82. Accordingly, the controller C may set the duty ratio of the refrigerant flow paths 4 and 5 to allow a difference between the inlet-side refrigerant temperature and the outlet-side refrigerant temperature of the refrigerant flow paths 4 and 5 to be constant, for example, between 0° C. and 10° C. The controller C may allow a difference between the inlet-side refrigerant temperature and the outlet-side refrigerant temperature of the evaporator 3 to be within a predetermined range by setting the duty ratio of the refrigerant flow paths 4 and 5.

In addition, for example, the processor may be configured to individually set the duty ratio of the refrigerant flow paths 4 and 5 based on a rotation speed of the compressor 1, a rotation speed of a circulating fan configured to circulate cold air inside the main body, a period of time elapsed after the start of the cooling operation, and an internal temperature of the main body or an external temperature of the main body. By such a setting, it is possible to optimally set the heat exchange efficiency while suppressing the drift of the refrigerant flow paths 4 and 5.

Due to the frost, the flow of cold air supplied to the evaporator 3 may be changed over time after the start of the cooling operation. Accordingly, in terms of suppressing a decrease in the amount of heat exchange, it is appropriate to set the duty ratio of the duty control for each of the refrigerant flow paths 4 and 5 according to the elapsed time after the start of the cooling operation. Therefore, it is possible to suppress a decrease in the amount of heat exchange by increasing the duty ratio of the duty control of the refrigerant flow path with which a large amount of cold air is in contact as the time passes.

In the refrigerator 100 according to an embodiment of the disclosure configured as described above, the flow rate of the refrigerant flowing through the refrigerant flow paths 4 and 5 is adjusted by individually duty-controlling the opening and closing times of the plurality of refrigerant flow paths 4 and 5. Therefore, it is possible to reduce the drift of the refrigerant generated in the plurality of refrigerant flow paths 4 and 5 while maintaining high heat exchange efficiency by performing the heat exchange through the plurality of refrigerant flow paths 4 and 5 in the evaporator 3.

OTHER MODIFIED EMBODIMENTS

The disclosure is not limited to the above embodiment.

For example, the refrigerator 100 according to the above embodiment may allow any one of the refrigerant flow paths 4 and 5 to be in the open state, but is not limited thereto.

Figure 4:
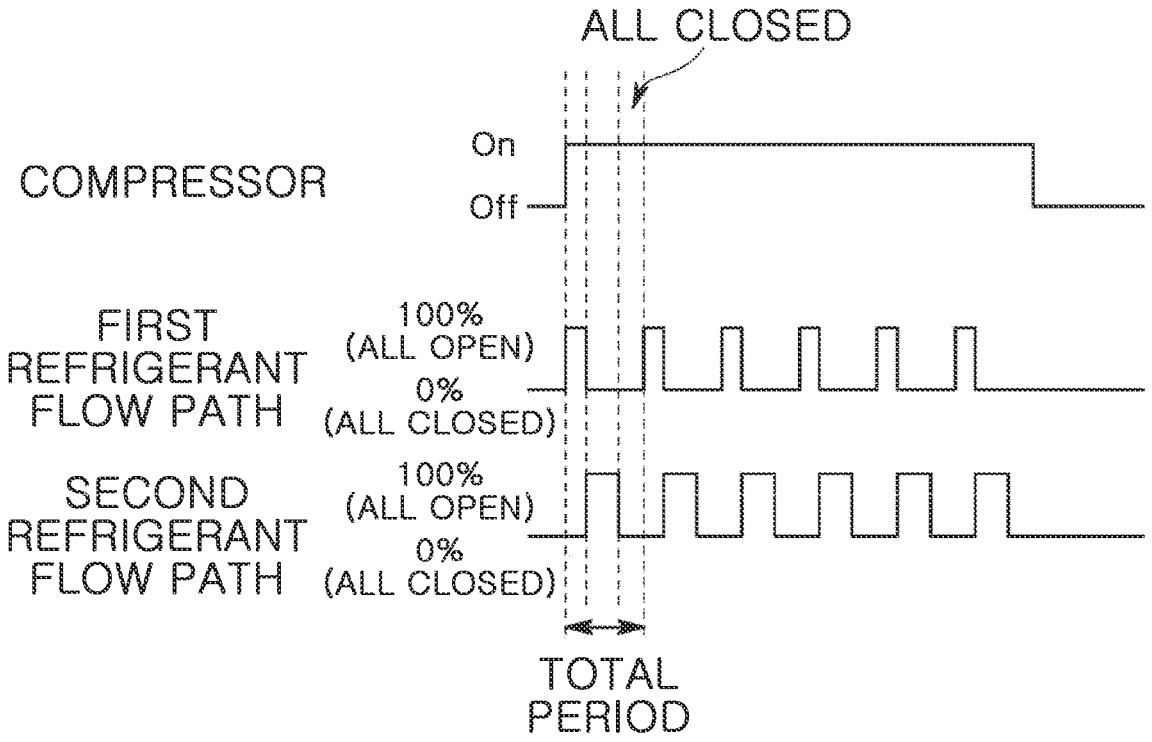
FIG. 4 is a view illustrating control of a refrigerator according to an embodiment of the disclosure.

FIG. 4 is a view illustrating control of a refrigerator according to an embodiment of the disclosure.

Referring to FIG. 4, a refrigerator 100 according to another embodiment of the disclosure may include an all-closed state in which both of the refrigerant flow paths 4 and 5 are in the closed state in the total period during the cooling operation. It is possible to reduce a total amount of circulating refrigerant by including the all-closed state and for example, it is possible to obtain an optimal flow rate of refrigerant under the condition that the refrigerant amount is excessive.

The refrigerator 100 according to the above embodiment is provided with a switching valve 6 composed of a three-way valve at the branch point of the refrigerant flow paths 4 and 5, but is not limited thereto. The switching valve may vary as long as capable of individually switching the open and closed state of the refrigerant flow paths 4 and 5. For example, a switching valve according to another embodiment may be a plurality of opening and closing valves 9 provided on each of the refrigerant flow paths 4 and 5, respectively, as shown in FIG. 5

Figure 5:
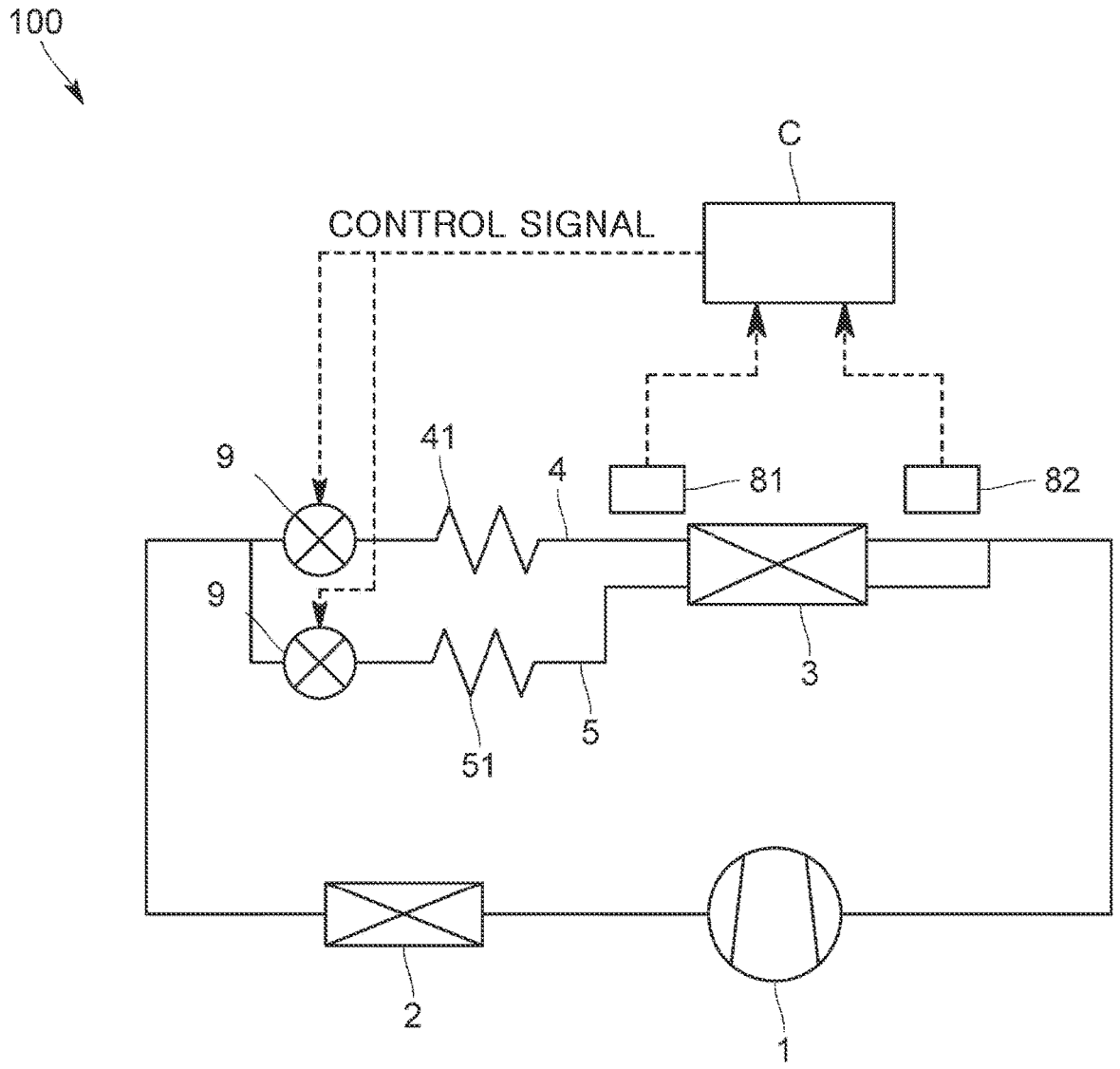
FIG. 5 is a diagram illustrating a refrigeration cycle of a refrigerator according to an embodiment of the disclosure.

FIG. 5 is a diagram illustrating a refrigeration cycle of a refrigerator according to an embodiment of the disclosure.

In addition, a resistance values of the capillary tube forming the pressure reducing device provided in each of the refrigerant flow paths 4 and 5 may be the same or different from each other. The pressure reducing device may include an expansion valve other than a capillary tube.

In the refrigerator 100 according to the above embodiment, the each of the return flow paths 71 and 72 and the each of the refrigerant flow paths 4 and 5 are arranged side by side in the front and rear direction of the refrigerator 100, but is not limited thereto. According to another embodiment of the disclosure, each of the return flow paths 71 and 72 may be provided to supply cold air in a left and right direction of the evaporator 3. Each of the refrigerant flow paths 4 and 5 may be arranged side by side in the left and right direction of the evaporator 3.

In addition, the refrigerator 100 according to the above embodiment includes the plurality of return flow paths 71 and 72, but is not limited thereto. According to another embodiment, a single return flow path may be provided. According to another embodiment, the refrigerator 100 may be configured to perform one of a cooling operation of the refrigerating compartment or a cooling operation of the freezing compartment.

In addition, the refrigerator 100 according to the above embodiment includes two refrigerant flow paths passing the evaporator 3, but is not limited thereto. According to another embodiment, three or more refrigerant flow paths passing through the evaporator 3 may be provided.

Further, the refrigerator 100 according to the above embodiment may be an integral type in which the refrigerating compartment and the freezing compartment are provided in a single cabinet. Alternatively, the refrigerator according to another embodiment may be a combined type in which the refrigerating compartment and the freezing compartment are provided in different cabinets, respectively.

As is apparent from the above description, a refrigerator, in which heat exchange is performed by a plurality of refrigerant flow paths, may reduce the drift of refrigerant.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:

a refrigeration cycle comprising:

a compressor, a condenser, a plurality of refrigerant flow paths branched downstream of the condenser and each comprising a pressure reducing device, an evaporator connected to the plurality of refrigerant flow paths, respectively, and a plurality of return flow paths provided to return cold air supplied into a main body of the refrigerator back to the evaporator,; and a processor comprising a switching valve configured to individually switch an open or closed state of each of the plurality of refrigerant flow paths, wherein the processor is configured to:

adjust a flow rate of refrigerant flowing in each of the plurality of refrigerant flow paths by individually duty-controlling an opening and closing time of each of the plurality of refrigerant flow paths by controlling the switching valve, and set a duty ratio of a duty control for each of the plurality of refrigerant flow paths according to an amount of cold air flowing through each of the plurality of return flow paths.

2. The refrigerator of claim 1, wherein the processor is further configured to set a duty ratio of a duty control, for a refrigerant flow path among the plurality of refrigerant flow paths, having a relatively larger amount of cold air performing heat exchange, to be greater than a duty ratio of a duty control, for another refrigerant flow path among the plurality of refrigerant flow paths, having a relatively smaller amount of cold air performing the heat exchange.

3. The refrigerator of claim 1, wherein the plurality of refrigerant flow paths comprise a first refrigerant flow path and a second refrigerant flow path, wherein the processor is further configured to control the switching valve to close the second refrigerant flow path in response to opening the first refrigerant flow path, and wherein the processor is further configured to control the switching valve to open the second refrigerant flow path in response to closing the first refrigerant flow path.

4. The refrigerator of claim 1, wherein the processor is further configured to control the switching valve to provide an all-closed state, in which all of the plurality of refrigerant flow paths are maintained in the closed state during a cooling operation.

5. The refrigerator of claim 1, wherein the plurality of return flow paths are arranged at a front and a rear of the evaporator so as to supply the cold air inside the main body again to the evaporator, and wherein the plurality of refrigerant flow paths are arranged side by side in a front and rear direction in the evaporator.

6. The refrigerator of claim 1, wherein the plurality of return flow paths are arranged on left and right sides of the evaporator so as to supply the cold air inside the main body again to the evaporator, and wherein the plurality of refrigerant flow paths are arranged side by side in a left and right direction in the evaporator.

7. The refrigerator of claim 1, wherein the plurality of return flow paths comprise a first return flow path provided to return cold air, which is supplied to a refrigerating compartment of the refrigerator, to the evaporator, and a second return flow path provided to return cold air, which is supplied to a freezing compartment of the refrigerator, to the evaporator.

8. The refrigerator of claim 7, wherein the plurality of refrigerant flow paths are configured to allow cold air that is introduced from the first return flow path and from the second return flow path to perform heat exchange.

9. The refrigerator of claim 1, further comprising:

an inlet side temperature sensor configured to measure a refrigerant temperature of each of the plurality of refrigerant flow paths at an inlet side of the evaporator; and an outlet side temperature sensor configured to measure a refrigerant temperature of each of the plurality of refrigerant flow paths at an outlet side of the evaporator, wherein the processor is further configured to set a duty ratio of a duty control for each of the plurality of refrigerant flow paths based on a refrigerant temperature measured by the inlet side temperature sensor and a refrigerant temperature measured by the outlet side temperature sensor.

10. The refrigerator of claim 1, further comprising:

a fan configured to circulate cold air in a main body of the refrigerator, wherein the processor is further configured to set a duty ratio of duty control for each of the plurality of refrigerant flow paths based on a rotation speed of the fan.

11. The refrigerator of claim 1, wherein the processor is further configured to set a duty ratio of duty control for each of the plurality of refrigerant flow paths based on a rotation speed of the compressor.

12. The refrigerator of claim 1, wherein the processor is further configured to set a duty ratio of duty control for each of the plurality of refrigerant flow paths based on an internal temperature of a main body of the refrigerator.

13. The refrigerator of claim 1, wherein the processor is further configured to set a duty ratio of duty control for each of the plurality of refrigerant flow paths based on a period of time elapsed after a start of a cooling operation.

14. The refrigerator of claim 1, wherein the plurality of refrigerant flow paths are configured to merge downstream of the evaporator.

15. The refrigerator of claim 1, wherein a period of a duty control for each of the plurality of refrigerant flow paths is set to be less than or equal to 200 seconds.

16. The refrigerator of claim 1, wherein the switching valve comprises a three-way valve provided at a branch point of a first refrigerant flow path and a second refrigerant flow path.

17. The refrigerator of claim 1, wherein the switching valve comprises a plurality of opening and closing valves provided on each of the refrigerant flow paths, respectively.

18. A refrigerator comprising:

a refrigeration cycle comprising:

a compressor, a condenser, a plurality of pressure reducing devices, and an evaporator;

a first refrigerant flow path branched at a point downstream of the condenser, comprising one of the plurality of pressure reducing devices, and connected to the evaporator;

a second refrigerant flow path branched at a point downstream of the condenser, comprising another of the plurality of pressure reducing devices, and connected to the evaporator;

a switching valve configured to individually switch an open or closed state of the first refrigerant flow path and of the second refrigerant flow path; and a processor configured to:

adjust a flow rate of refrigerant flowing in the first refrigerant flow path and in the second refrigerant flow path by individually duty-controlling an opening and closing time of the first refrigerant flow path and of the second refrigerant flow path by controlling the switching valve, set a duty ratio of a duty control for the first refrigerant flow path to be greater than a duty ratio of a duty control for the second refrigerant flow path in response to an amount of cold air exchanging heat with the first refrigerant flow path being greater than an amount of cold air exchanging heat with the second refrigerant flow path, and set a duty ratio of the duty control for the first refrigerant flow path to be less than a duty ratio of the duty control for the second refrigerant flow path in response to that an amount of cold air exchanging heat with the first refrigerant flow path being less than an amount of cold air exchanging heat with the second refrigerant flow path.

* * * * *